US008087840B2

(12) United States Patent
Yoon

(10) Patent No.: US 8,087,840 B2
(45) Date of Patent: Jan. 3, 2012

(54) SLIDE TYPE WRITING TOOL PREVENTING DRYNESS

(75) Inventor: Hyun-Son Yoon, Seoul (KR)

(73) Assignee: Morris Corporation, Incheon-Shi (KR)

( * ) Notice: Subject to any disclaimer, the term of this patent is extended or adjusted under 35 U.S.C. 154(b) by 211 days.

(21) Appl. No.: 12/376,431

(22) PCT Filed: Aug. 6, 2007

(86) PCT No.: PCT/KR2007/003773

§ 371 (c)(1),
(2), (4) Date: Jan. 14, 2010

(87) PCT Pub. No.: WO2008/029993

PCT Pub. Date: Mar. 13, 2008

(65) Prior Publication Data

US 2011/0058888 A1 Mar. 10, 2011

(30) Foreign Application Priority Data

Aug. 4, 2006 (KR) ..... 10-2006-0073906

(51) Int. Cl.
*B43K 7/12* (2006.01)

(52) U.S. Cl. ..... 401/108

(58) Field of Classification Search ..... 401/107, 401/108

See application file for complete search history.

(56) References Cited

U.S. PATENT DOCUMENTS 6,981,812 B1 1/2006 Hsieh
2005/0084320 A1 * 4/2005 Carroll ..... 401/108

FOREIGN PATENT DOCUMENTS

JP 2001-063271 A 3/2001
KR 10-2005-0105758 A 11/2005

* cited by examiner

*Primary Examiner* — Huyen Le

(74) *Attorney, Agent, or Firm* — Mannava & Kang PC; Hyunho Park

(57) ABSTRACT

A retractable writing instrument having a dryness prevention device is disclosed. The retractable writing instrument includes a casing (10), which has a nib hole therein, a cartridge (20), which has a nib coupling protrusion for coupling a nib (24) to a nib extension tube, and a spring for providing elastic restoring force. The writing instrument further includes an Oring member (50), which is coupled to the nib extension tube, and an openable ring (40), which is rotatably coupled to the Oring member (50). When a knock part is pushed, the openable ring (40) is rotated, such that a through passage is opened, and the nib is protruded outside through the nib hole. When the cartridge is moved backwards, the nib coupling protrusion of the cartridge holds the Oring member and is moved backwards along with the Oring member, thereby rotating the openable ring, thus closing the through passage.

5 Claims, 12 Drawing Sheets

SLIDE TYPE WRITING TOOL PREVENTING DRYNESS

TECHNICAL FIELD

The present invention relates, in general, to writing instruments and, more particularly, to a retractable writing instrument having a dryness prevention device in which a nib, through which ink is drawn out from a pen core, is extracted only when the writing instrument is in use, and in which the nib is retracted into and airtightly stored in a casing of the writing instrument when it is not in use.

BACKGROUND ART

Generally, writing instruments are classified into a stationary type writing instrument, in which a pen core is stationary and is covered with a cap, and a retractable writing instrument. The retractable writing instrument is classified into a rotating type writing instrument, in which a nib is moved along a spiral moving path by rotating part of a casing so that part of the nib is extractable from or retractable into the casing, a knock type writing instrument, in which, when part of a casing is pushed, a nib is extracted from the casing or is retracted into the casing using a spring, and a slide type writing instrument, in which a nib is extracted from or retracted into a casing by siding.

Here, the retractable writing instrument has an advantage in that it is not necessary to use a separate cap. However, because a nib hole, through which the nib is extracted from and retracted into a casing, is formed in an end of the casing, there is a disadvantage in that it must be limitedly used only for writing instruments using ink having low volatility or nonvolatile ink, for example, oil-based ink.

On the other hand, in the case of writing instruments using ink having high volatility, for example, marker pens, correction pens, water-based pens, highlighters, etc., as well as being inconvenient because a cap must be used, if a nib is exposed to air for a long time, the ink in the nib dries out, thus reducing the lifetime of the writing instrument, or spoiling it.

In an effort to overcome the above problems, a lot of research on techniques for preventing ink and for protecting a nib in writing instruments that use liquid or semi-liquid ink or volatile or nonvolatile ink has been conducted.

A representative technique for preventing a nib from drying out and for protecting the nib was proposed in Japanese Patent No. 1987-0012570, which is entitled 'CAPLESS WRITING INSTRUMENT HAVING DRYNESS PREVENTION DEVICE'. In the writing instrument according to this technique, when a pushing part is pushed, a cover, which covers a nib, is opened by the tensile force of an elastic cord. In this state, when the pushing part is pushed again, the cover is closed to seal the nib, thus preventing ink from drying out. However, because the tensile force of the elastic cord is used to open and close the cover, the operation of opening or closing the cover cannot be rapidly conducted, and the durability is insufficient. Furthermore, there is a disadvantage in that the sealing ability of the cover, which openably closes a nib opening, is very low.

Meanwhile, another conventional technique pertaining to a retractable writing instrument was proposed in 1999 in Korean Utility Model Registration No. 174279, entitled 'NIB DRYING PREVENTION DEVICE'. In this technique, when a pushing part of the retractable writing instrument is pushed, the nib is advanced forwards and protruded outside through a slit in a rubber packing, thus enabling the use of the writing instrument. When the pushing part is released or pushed again, the nib is returned to its original position, and the slit is sealed by the elastic force of the rubber, thus preventing the ink from drying out.

However, in the case where the writing instrument is frequently used for a long period, the rubber packing having the slit may be plastically deformed. Furthermore, it is difficult to seal the pushing part that undergoes sliding movement. Therefore, the sealing ability of the writing instrument is relatively low.

Another conventional technique was proposed in Korean Patent Application No. 65693 in 2000, entitled 'WRITING INSTRUMENT HAVING NON-SEPARABLE TYPE ELASTIC CAP'. In this technique, a slit, through which a nib passes, is formed in an elastic cap at a position adjacent to the nib, and the elastic cap is in close contact with a guide hole of a writing instrument which is formed at a position opposite the slit. When the cap is moved backwards, the nib is exposed outside to allow the use thereof. When the cap is advanced forwards, the writing instrument enters a state in which ink is prevented from drying out. In addition, the intermediate part of the cap has a shape corresponding to an associated part of the casing of the writing instrument.

However, in the case of the technique of No. 65693, because the nib is extracted or retracted through the slit, the part of the cap around the slit is easily stained with the ink of the nib. Furthermore, because the part of the cap around the slit is compressed by a separate assistant member, such as a rubber ring having predetermined elasticity, the nib may be damaged through contact with the cap around the slit. In addition, there is a disadvantage of low durability. As well, because the rubber ring that is provided around the slit is exposed outside, the rubber ring may be damaged by contact with other objects. Moreover, in the case where the writing instrument is frequently used for a long period, the part of the cap around the slit may be deformed, thus reducing the sealing ability.

DISCLOSURE

[Technical Problem]

Accordingly, the present invention has been made keeping in mind the above problems occurring in the prior art, and an object of the present invention is to provide a retractable writing instrument having a dryness prevention device, which can be rapidly opened or closed through a direct power transmitting method, so that a nib, which is an end of a pen core, can be extracted from or retracted into a casing in a non-contact manner, and which can reliably ensure airtightness without a separate cap, thus preventing ink in the nib from drying out, and can physically protect the nib, the retractable writing instrument being convenient to use.

Another object of the present invention is to provide a retractable writing instrument having the dryness prevention device, in which an O-ring member and an openable ring, which conduct a sealing function for preventing ink of the nib from drying out, are made of special rubber material.

[Technical Solution]

In order to accomplish the above objects, the present invention provides a retractable writing instrument having a dryness prevention device, and including an extraction and retraction control unit, the retractable writing instrument comprising: a casing (10), with a pair of guide slots (17) formed in the casing at positions spaced apart from a nib hole (13) by a predetermined distance, the guide slots being symmetrical with each other; a cartridge (20), having a nib coupling protrusion (22) to couple a nib (24) and a nib extension tube (23) to each other; a spring for providing elastic restoring force to the cartridge (20) in a direction in which the cartridge (20) is pushed; an O-ring member (50), which is closely coupled to the nib extension tube (23); and an openable ring (40) coupled to the O-ring member (50) such that the O-ring member (50) is received in the openable ring (40), the openable ring (40) being coupled to the casing (10) through the coupling means so as to be rotatable with respect to the O-ring member (50) to open or close a nib opening (51), so that, when a knock part (29) is pushed, the openable ring (40) is rotated with respect to the O-ring member (50), which is operated in conjunction with the knock part (29) and the cartridge, such that a through passage is opened in an axial direction of the nib (24), and the nib (24) is protruded outside through the nib hole (13), thus entering a state of permitting use thereof, and, when the cartridge (20) is moved backwards, the nib coupling protrusion (22) of the cartridge (20) holds the O-ring member (50) and is moved backwards along with the O-ring member (50), thereby the openable ring (40) is rotated, thus closing the through passage of the O-ring member (50).

ADVANTAGEOUS EFFECTS

The retractable writing instrument having a dryness prevention device according to the present invention has an advantage in that it can be conveniently used without using a separate cap. Furthermore, in response to the extraction or retraction of a nib, a nib hole of a casing is automatically opened or closed, thus effectively preventing ink from drying out.

Moreover, in the retractable writing instrument having the dryness prevention device according to the present invention, because an opening and closing mechanism is simple, the assembly process thereof is simplified, and the costs of manufacturing components can be reduced. Therefore, the present invention has an advantage in that it is very marketable.

Although the retractable writing instrument having the dryness prevention device according to the preferred embodiment of the present invention has been explained with reference to the attached drawings, this is only an illustrative example, and does not limit the present invention.

Furthermore, those skilled in the art will appreciate that various modifications, additions and substitutions are possible, without departing from the scope and spirit of the present invention.

BEST MODE

Hereinafter, a retractable writing tool having a dryness prevention device according to an embodiment of the present invention will be described in detail with reference to the attached drawings.

Figure 1:
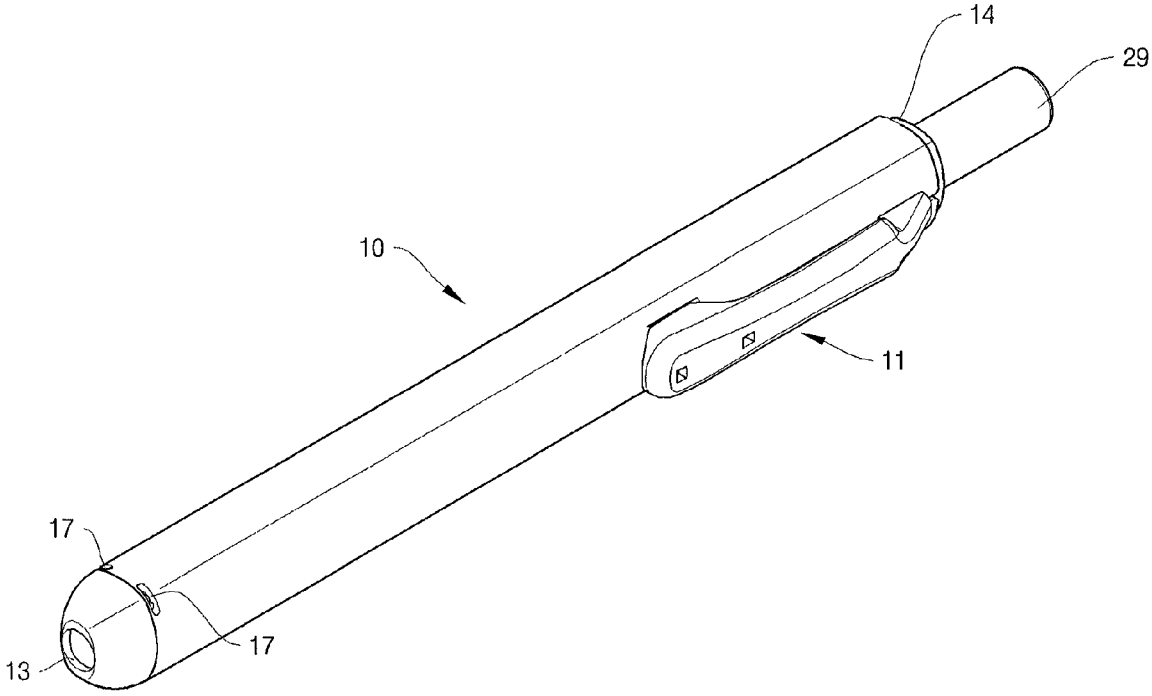
FIGS. 1 through 3 are perspective views and a sectional view of a casing of a retractable writing tool having a dryness prevention device, according to the present invention.
Figure 2:
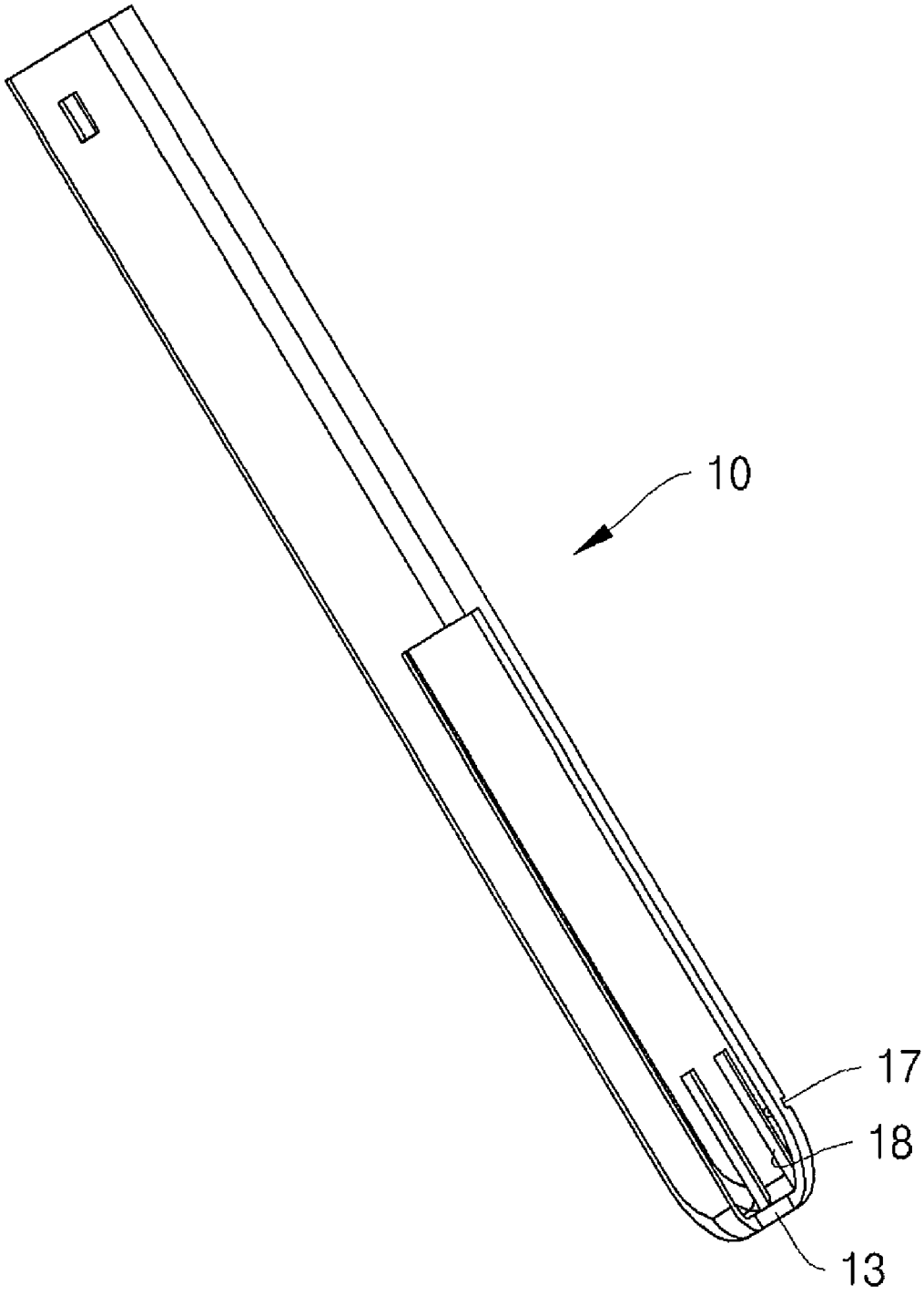
Figure 3:
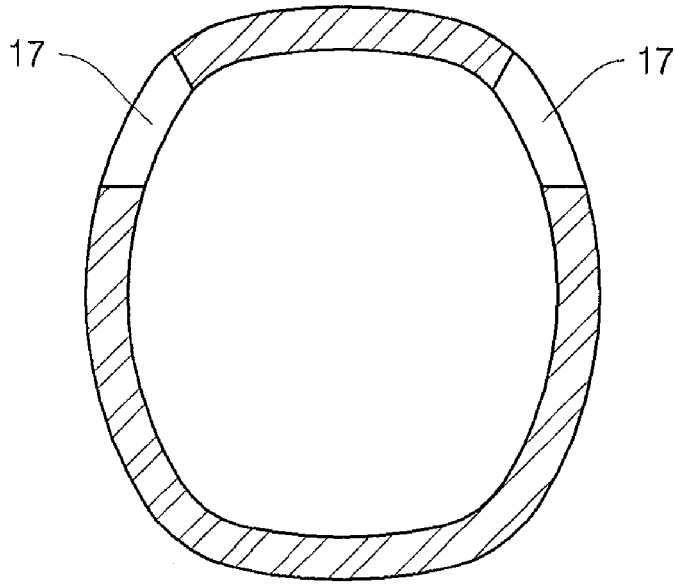
Figure 4:
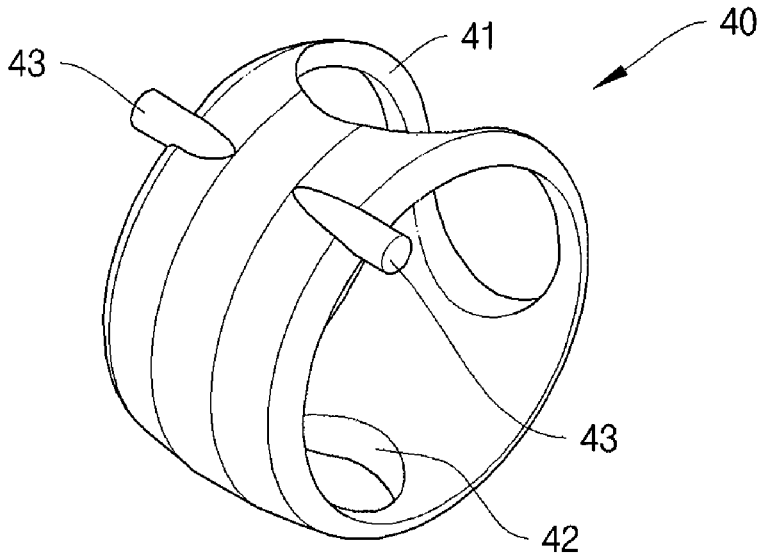
FIGS. 4 through 6 are perspective views and a side view of an openable ring according to the present invention.
Figure 5:
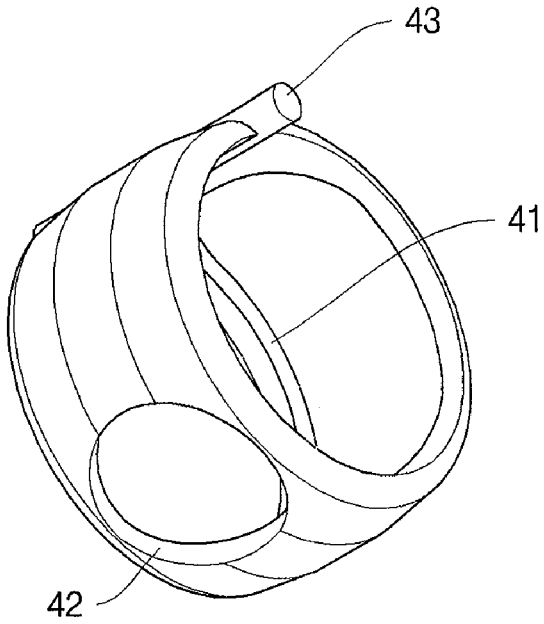
Figure 6:
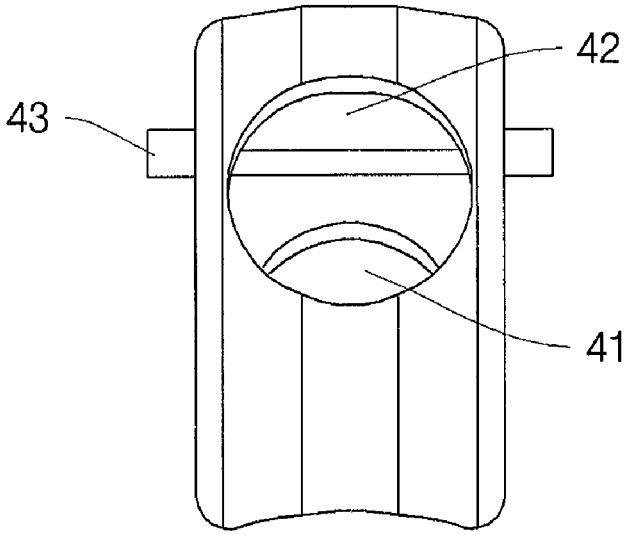
Figure 7:
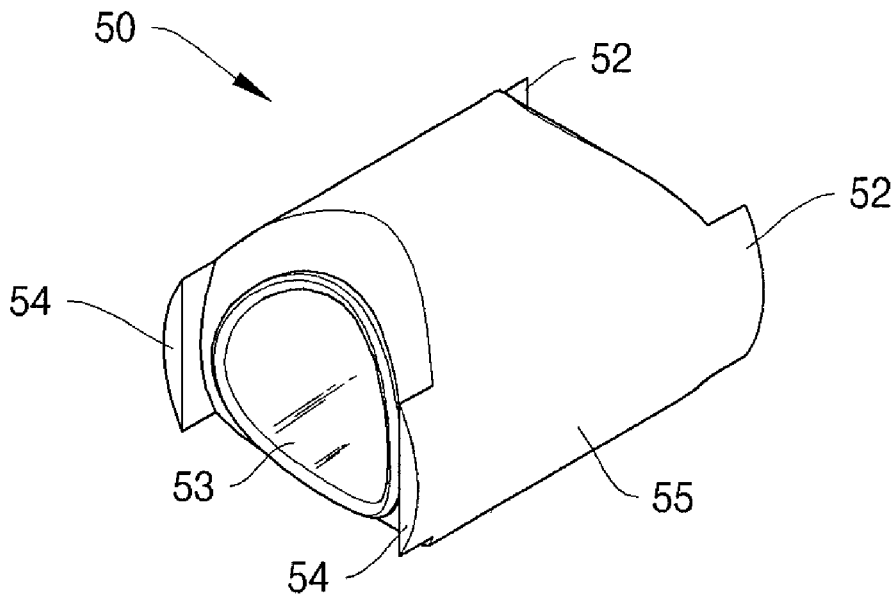
FIGS. 7 through 9 are perspective views and a sectional view of an O-ring member according to the present invention.
Figure 8:
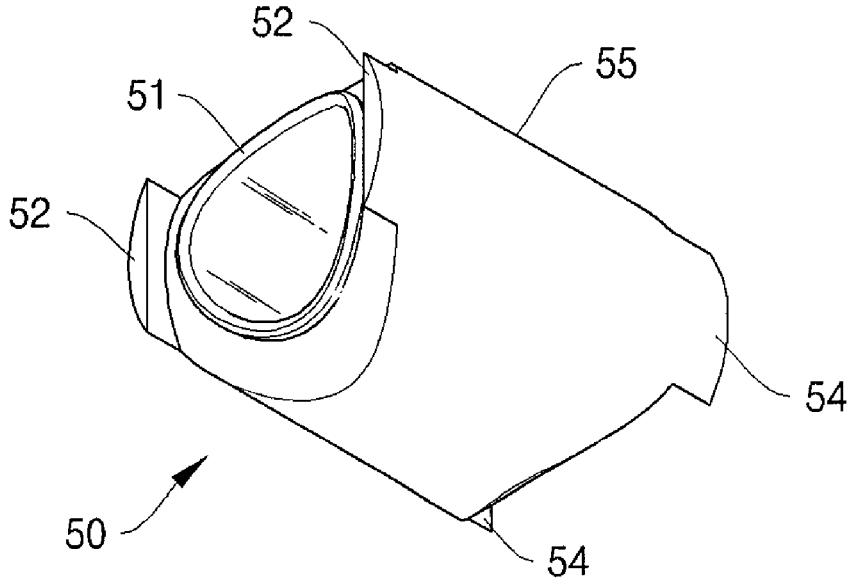
Figure 9:
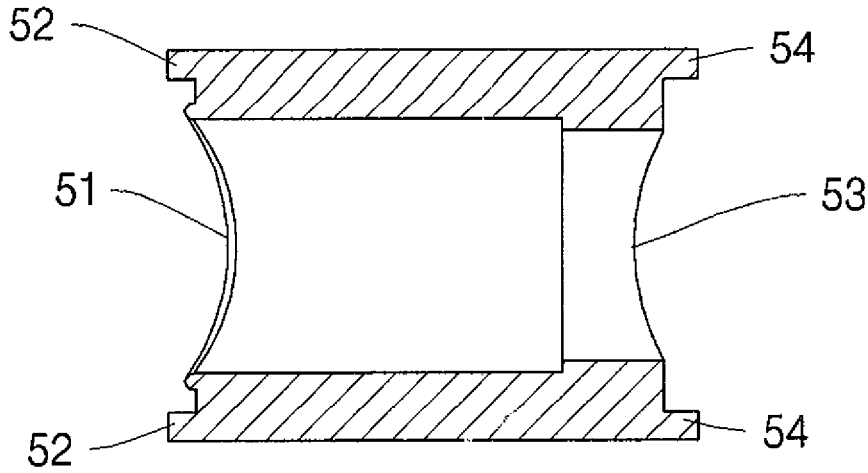

FIGS. 1 through 3 are perspective views and a sectional view of a casing of a retractable writing tool having a dryness prevention device, according to the present invention. FIGS. 4 through 6 are perspective views and a side view of an openable ring. FIGS. 7 through 9 are perspective views and a sectional view of an O-ring member.

Figure 10:
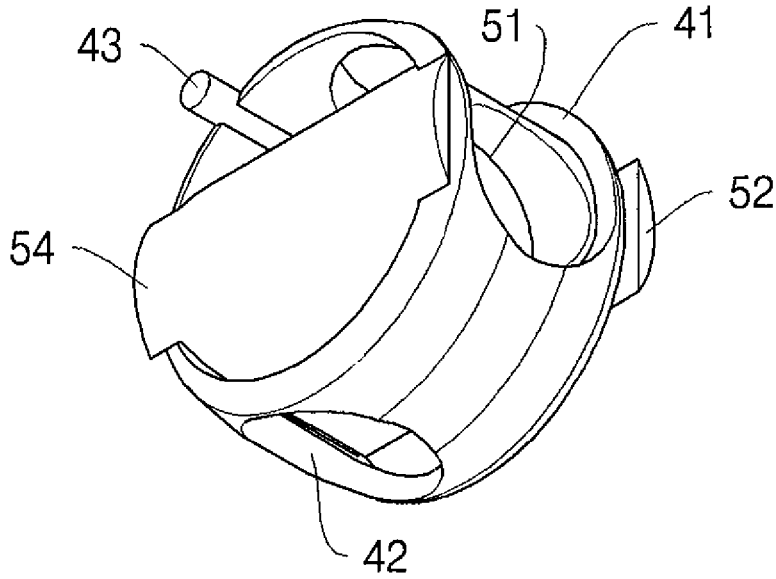
FIGS. 10 through 12 are a perspective views and sectional views showing the coupling of the openable ring to the O-ring member.
Figure 11:
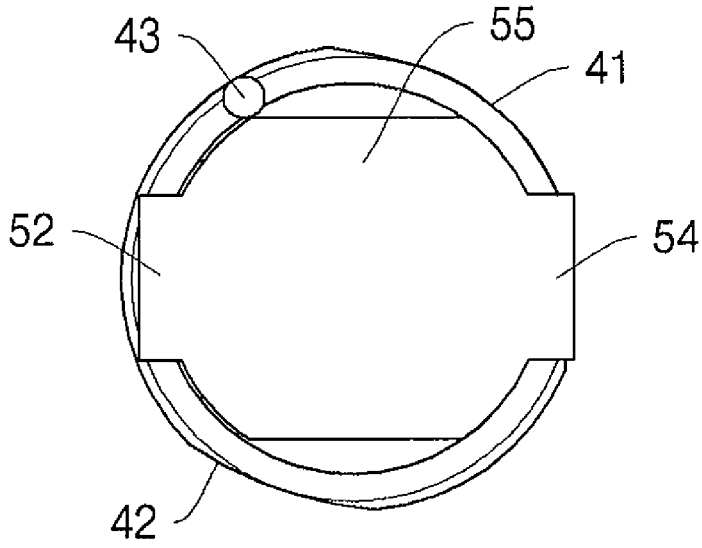
Figure 12:
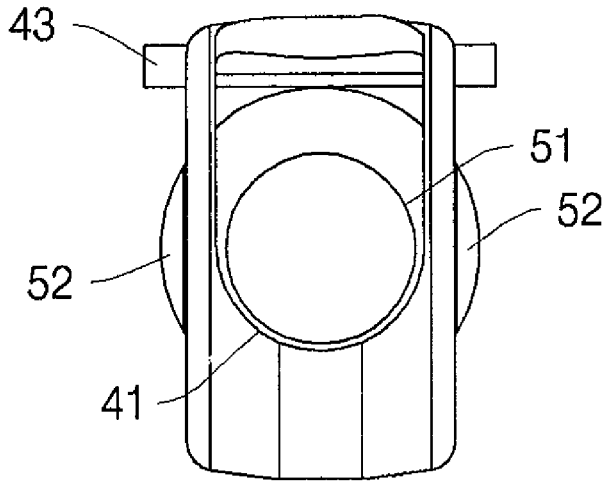
Figure 13:
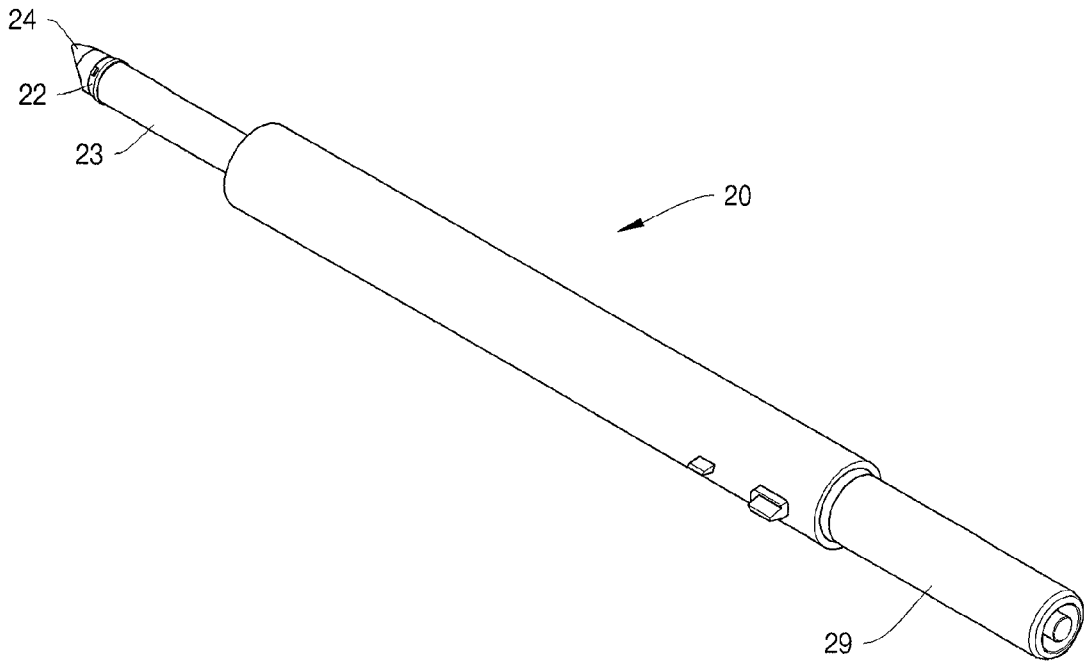
FIG. 13 is a perspective view of a cartridge according to the present invention.
Figure 14:
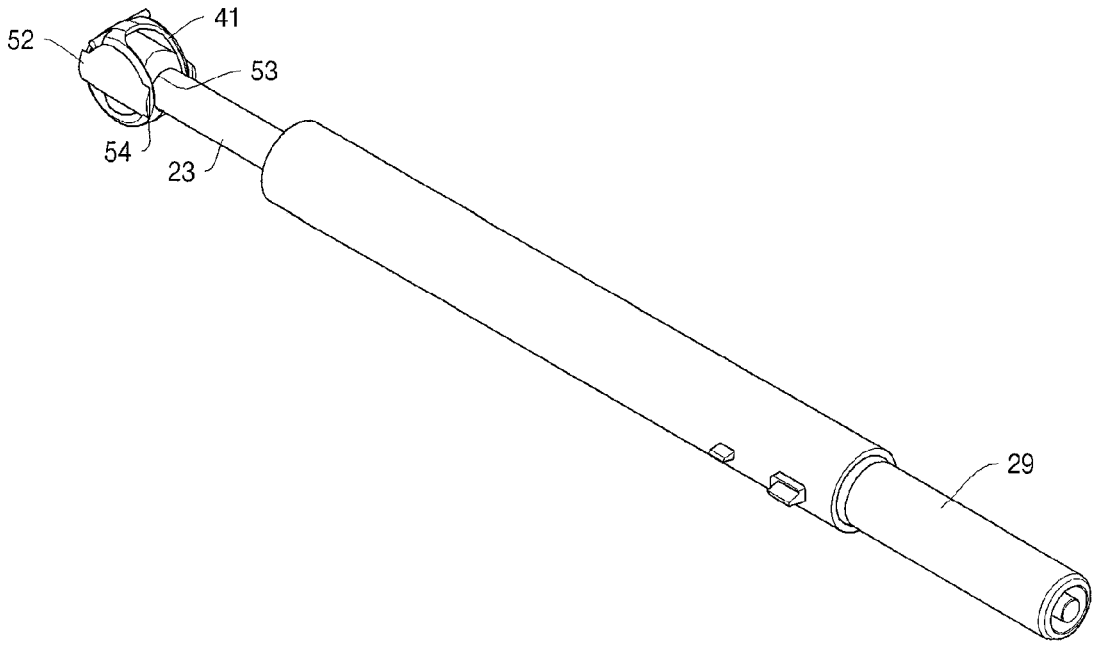
FIG. 14 is an assembled perspective view of the openable ring, the O-ring member and the cartridge.

FIGS. 10 through 12 are a perspective views and sectional views showing the coupling of the openable ring to the O-ring member. FIG. 13 is a perspective view of a cartridge according to the present invention. FIG. 14 is an assembled perspective view of the openable ring, the O-ring member and the cartridge.

Figure 15:
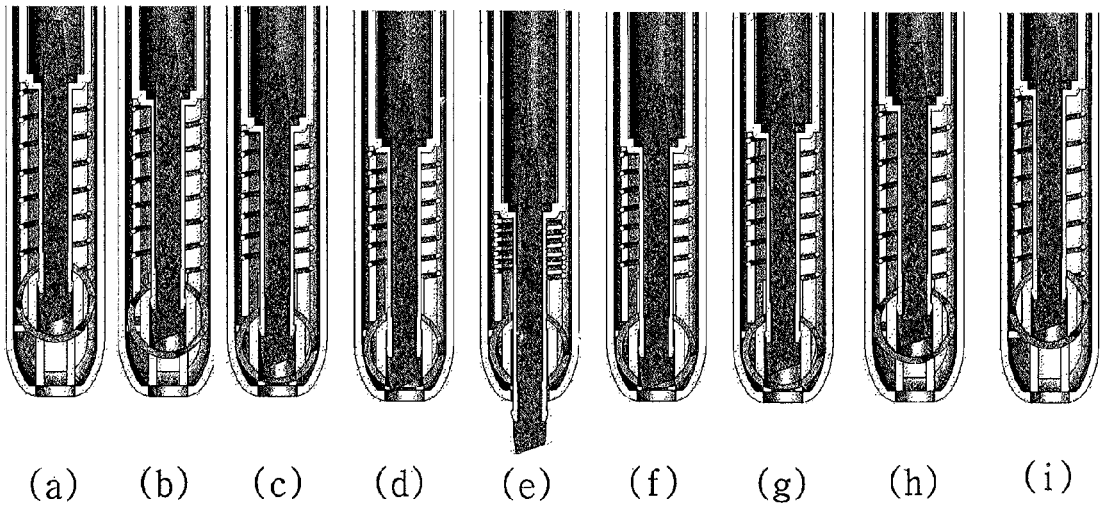
FIG. 15 is views showing the sequence of the operation of the retractable writing tool having the dryness prevention device according to the present invention.
Figure 16:
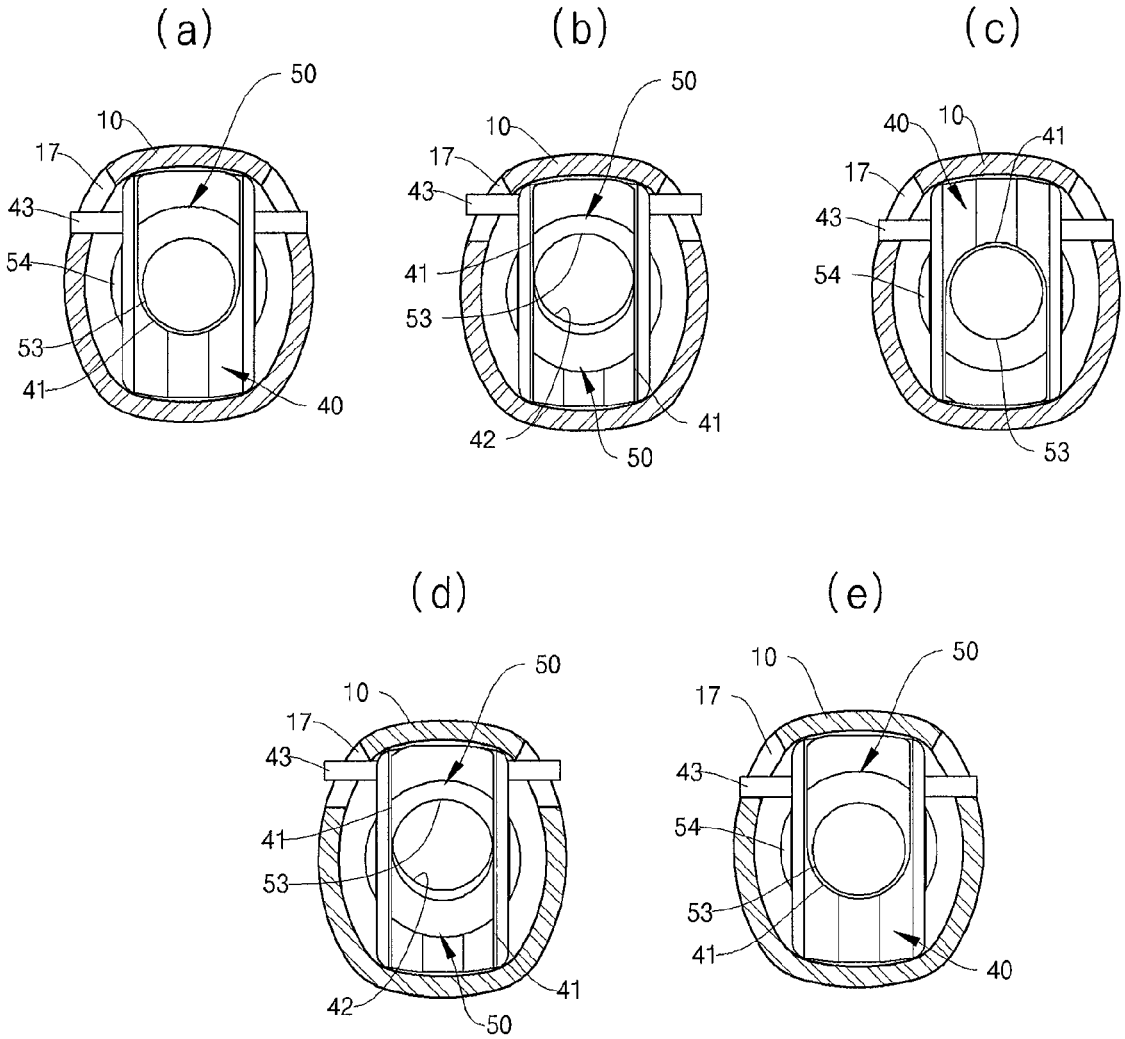
FIGS. 16 and 17 are sectional views showing the path along which a protrusion moves according to the operating sequence of FIG. 15.
Figure 17:
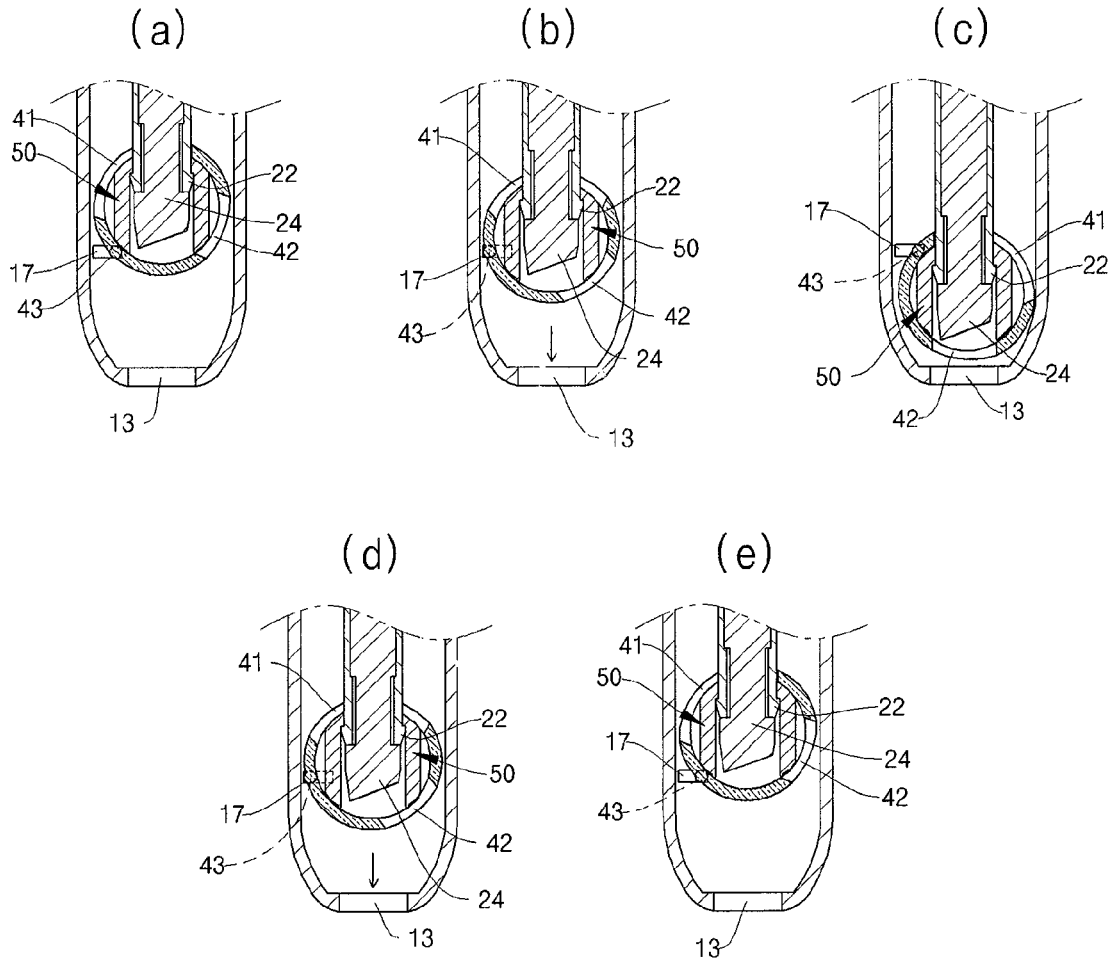

FIG. 15 is views showing the sequence of the operation of the retractable writing tool having the dryness prevention device according to the present invention. FIGS. 16 and 17 are sectional views showing the path along which a protrusion moves according to the operating sequence of FIG. 15. The present invention provides the writing instrument including the casing 10, which is formed into a single body or is separable into two bodies. Particularly, in the present invention, a dryness prevention device, which will be explained later herein, and which is operated in a direct power transmitting manner, is provided in the casing 10.

Here, the term "direct power transmitting manner" means a manner in which the force with which a user pushes a knock part 29 is directly transmitted to the openable ring of the dryness prevention device, which seals the nib hole 13 of the casing 10, thereby operating the openable ring and opening a nib opening of the O-ring member.

The nib hole 13 is formed in a first end of the casing 10 which has a conical shape, and the knock part 29 is provided in a second end of the casing 10.

In the present invention, the user holds the casing 10 of the writing instrument with one hand and pushes the knock part 29, which is the pushing part provided on the upper end of the writing instrument, using his/her thumb. Then, the openable ring, which is operated in conjunction with the knock part 29 via the cartridge, is rotated in a clockwise direction such that a through passage of the openable ring is aligned with the axis of the nib 24 and the nib hole 13 of the casing 10 is thus opened. Thereafter, the nib 24 protrudes outside the nib hole 13 through a circular hole of the openable ring, thus entering a usable state. In this state, when the user pushes the knock part 29 again, the nib 24, which has protruded, is returned by the elastic force of a spring, which is installed in the casing, to its original position, that is, into the casing 10. Simultaneously, the openable ring is rotated in a counterclockwise direction such that the circular hole of the openable ring is perpendicular to the axis of the nib 24 and the nib hole 13 of the casing 10 is thus closed.

The retractable writing instrument having the dryness prevention device according to the present invention includes the casing 10, the cartridge 20, the O-ring member 50, the openable ring 40 and the spring, that is, it has a total of five elements. As such, compared to the conventional art having ten or more elements, the present invention can reduce the number of elements, thus making the assembly process easy.

In detail, referring to FIG. 1, the casing 10 is constructed such that it is formed as a single body or is separable into two bodies. Furthermore, the casing 10 is manufactured by injection molding or casting using one selected from rubber, silicone and soft plastic.

Therefore, the casing 10 has the general characteristics of plastic material, such as elasticity or flexibility.

Here, the nib hole 13, which has a size appropriate for the insertion of the nib 24 connected to the cartridge 20, is axially formed through the first end of the casing 10. A cartridge insert hole 14, which has a size appropriate for the insertion of the cartridge 20, is formed through the second hole of the casing 10.

Furthermore, an extraction and retraction control unit 11, which can be designed in various ways, is integrally or separately provided on the circumferential outer surface of the second end of the casing 10.

Preferably, using the connection relationship between the extraction and retraction control unit 11 and elements pertaining thereto, the extraction and retraction control unit 11 may be operated in conjunction with the elements such that the nib 24 can maintain the extracted or retracted state thereof.

In addition, the casing 10 has the nib hole 13 in the conical-shaped first end thereof, and has in the second end thereof the insert hole 14, which has an inner diameter appropriate for the insertion of the knock part 29 and the following elements. When viewed from outside, the knock part 29 is provided in an arrangement in which it is coupled to the insert hole 14. Referring to FIG. 1, the knock part 29 serves to transmit the force with which the user pushes it to the cartridge 20. The knock part 29 has a tube shape, which has a circumferential inner surface having a predetermined diameter and a circumferential outer surface having a predetermined diameter. The knock part 29, having the above-described shape, is open at a first end thereof and is closed at a second end thereof.

When the direction of the nib hole 13 is defined as the forward direction and the direction of the insert hole 14, into which the knock part is inserted, is defined as the backward direction, a pair of guide slots 17 is formed at symmetrical positions through the circumferential surface of the handle part of the casing, which is held in the hand of the user, as shown in FIGS. 2 and 3.

The guide slots 17 provide a path, along which protrusions of the openable ring, which will be explained later herein, are rotated and moved.

As shown in FIG. 2, linear ribs 18, which serve to hold one end of the spring such that the spring is prevented from being rotated, are axially provided on the inner surface of the front end of the casing 10.

FIGS. 4 through 6 illustrate the openable ring 40. The openable ring 40 has an elliptical hole 41, the circular hole 42, and the protrusions 43. The openable ring 40 is made of material, such as plastic having a predetermined elasticity, equal to that of the O-ring member 50, which will be explained later herein. Preferably, the openable ring 40 is formed through injection molding.

Furthermore, to minimize friction generated when the openable ring 40 is rotated with respect to the O-ring member for conducting an opening or closing operation, lubricant is applied thereto. In the present invention, silicone oil, having one hundred thousand or more of viscosity, is used as the lubricant.

The openable ring 40 provides an opening for extraction or retraction of the nib, which is surrounded by the O-ring member, using its rotation around the protrusion 43, which serves as a rotating shaft.

The elliptical hole 41 has along the major axis thereof a guide line, along which the openable ring is moved in the state in which the O-ring member and the nib are inserted in the casing.

The circular hole 42 has the same diameter as the length of the minor axis of the elliptical hole 41. The circular hole 42 has the opening, through which the nib, which has been covered with the openable ring, is advanced to the nib hole 13.

The two protrusions 43 protrude from the respective opposite edges of the openable ring 40.

FIGS. 7 and 8 illustrate the O-ring member 50. The O-ring member 50 has a cylindrical shape, the upper and lower ends of which are open, and includes a nib opening 51, upper support stops 52, a nib sealing member 53, and lower support stops 54.

Under normal conditions, the nib opening 51 is in a state in which it is closed by the sidewall of the openable ring 40. When the openable ring 40 is moved in one direction, the nib opening 51 is aligned with the circular hole 42 of the openable ring 40, thereby forming the opening through which the nib can pass.

The upper support stops 52 longitudinally and linearly extend from a first end of the sidewall 55 of the O-ring member 50 in an outward direction from the nib opening 51.

The nib sealing member 53 defines a hole, which is closely fitted over a nib extension tube connected to the nib.

The lower support stops 54 longitudinally and linearly extend from a second end of the sidewall 55 of the O-ring member 50 in an outward direction from the nib sealing member 53.

The upper support stops 52 and the lower support stops 54 serve to support the openable ring 40 such that the openable ring 40, which is coupled to the O-ring member 50 and is rotated relative thereto, is prevented from being undesirably removed from the O-ring member 50.

FIGS. 10 through 12 illustrate the coupling between the openable ring 40 and the O-ring member 50.

As shown in FIG. 10, the openable ring 40 receives the O-ring member 50 therein and is coupled to the O-ring member 50 such that they are prevented from being undesirably separated from each other using the upper support stops 52 and the lower support stops 54 of the O-ring member 50. Particularly, as can be appreciated in the sectional view of FIG. 11, the openable ring 40 and the O-ring member 50 have diameters and heights corresponding to each other such that they can be closely coupled to each other.

Meanwhile, as shown in FIG. 13, the cartridge 20 has a tank part having an appropriate capacity such that ink can be evenly and continuously supplied through the nib 24 for a finite amount of time corresponding to the capacity of the ink tank.

Here, the nib 24 is coupled to the first end of the cartridge 20. In detail, the nib 24 is fitted into a coupling hole of the first end of the nib extension tube 23, so that the nib 24 is supplied with ink through the nib extension tube 23.

The nib extension tube 23 has a hollow tube shape for the supply of ink, and has a diameter less than that of the tank part.

The nib 24 is fastened to the first end of the nib extension tube 23, so that the ink or other contents in the tank part is supplied to the nib 24 in a typical supply method (for example, a capillary method, a method using a pressure difference, a suction method, etc.) depending on the kind of writing instrument.

Furthermore, the nib extension tube and the nib are coupled to each other via a nib coupling protrusion 22.

In the operation of the dryness prevention device of the retractable writing instrument, which will be explained later herein, when the cartridge 20 is moved backwards, the nib coupling protrusion 22 serves to catch the nib sealing member 53 of the O-ring member 50, such that the O-ring member 50 is moved backwards along with the cartridge 20.

Depending on the kind of writing instrument, the nib 24 may comprise an oil-based or water-based nib, a nib for correction pens, a nib for highlighters, a nib for markers, etc. Of course, an ink supply method corresponding to the kind of nib is applied to the writing instrument. The cartridge 20 is operated in conjunction with the extraction and retraction control unit 11, and an extraction and retraction mechanism that is used in a typical retractable writing instrument is applied to the coupling structure therebetween.

For example, a mechanism equal to or similar to the anti-noise nib extraction and retraction mechanism of a safety knock type writing instrument, which was proposed in Korean Patent Application Nos. 2003-55414 and 2003-56940, filed by the inventor of the present invention, may be applied to the coupling structure between the cartridge 20 and the extraction and retraction control unit 11 of FIG. 1, which are operated in conjunction with each other.

The cartridge 20 having the above-mentioned structure is inserted into the casing 10 through the cartridge insert hole 14. The cartridge 20 is axially reciprocable within a predetermined stroke range such that, when the user manipulates the extraction and retraction control unit 11, the nib 24 is extracted from or retracted into the nib hole 13 of the casing 10 through the above-mentioned extraction and retraction mechanism. In addition, the cartridge 20 is constructed such that it can maintain a temporarily stopped state at opposite ends of the stroke.

The spring (not shown in this drawing, but shown in the following drawing, which shows the operational relationship between the elements) contacts at a first end thereof the stepped lower end of the cartridge 20 and contacts at a second end thereof the ribs 18 of the casing 10.

The spring 7 serves to push the cartridge 20 in the axial direction within the stroke range of the cartridge 20 when the nib retraction operation is conducted.

That is, when the cartridge 20 and the knock part 29 are advanced forwards a predetermined distance, the spring 7 enters a state of being compressed. Thereby, the spring 7 generates elastic repulsive force, by which it is biased from the compressed state to the extended state.

In the present invention, the distance of the stroke of the cartridge 20 is the same as that of the knock part 29.

FIG. 14 illustrates the coupling relationship between the cartridge 20, the openable ring and the O-ring member 50.

The nib is inserted into the nib sealling member 53, which is opened through the elliptical hole 41, such that the nib is placed in the O-ring member 50, and the nib extension tube, connected to the nib, is in close contact with the nib sealing member 53.

At this time, the openable ring 40 is in the state in which it is held and supported by the upper support stops 52 and the lower support stops 54, so as to be rotatable within the range of the guide line, defined by the elliptical hole 41.

FIG. 15 shows a process of extracting and retracting the nib in the operation of the retractable writing instrument having the dryness prevention device according to the present invention. FIGS. 16 and 17 are sectional views showing the path along which the protrusions move, according to the extraction and retraction of the nib of FIG. 7.

In detail, FIG. 16 is sectional views taken along the guide slots 17, in which respective protrusions 43 are placed, in a direction perpendicular to the axial direction. FIG, 17 is views showing enlargements of FIG. 15 to illustrate in detail the protrusions and the guide slots.

As shown in FIGS. 15*a*, 16*a* and 17*a*, the nib is placed in the passage defined in the O-ring member 50. The nib is reliably isolated from the outside by the sidewall of the openable ring 40, which seals the nib opening 51 at a first side, and by the nib sealing member 53, which closely contacts the nib extension tube at a second side.

Furthermore, the protrusions 43 are in contact with the respective first ends of the guide slots 17 of the casing 10. The spring 7 contacts at the first end thereof the stepped lower end of the cartridge 20, and contacts at the second end thereof the sidewalls of the ribs 18 of the casing 10.

In this state, as shown in FIGS. 15*b*, 16*b* and 17*b*, when the knock part is pushed, the cartridge 20 is advanced, and the spring is compressed.

Then, the O-ring member 50 and the openable ring 40, which are connected to the cartridge 20, are advanced together with the cartridge 20.

Here, the O-ring member 50 and the cartridge 20 are linearly moved along the passage defined through the casing 10, but, because the protrusions 43 of the openable ring 40 are in the state in which they are placed by the respective guide slots 17 of the casing 10, the openable ring 40 is rotated around the protrusions 43 while linearly moving.

Furthermore, because the openable ring 40 is linearly moved along with the O-ring member 50 and the cartridge 20 in the state in which the protrusions 43 thereof are placed in the respective guide slots 17, as shown in FIGS. 16*b* and 17*b*, the protrusions 43 are slowly moved to the right along the guide slots 17 until they contact the respective second ends of the guide slots 17, thus making the rotation of the openable ring 40 possible.

In this embodiment, when the openable ring 40 is rotated around the protrusions 43, the sidewall thereof, including the elliptical hole 41 and the circular hole 42, is rotated in a clockwise direction as seen in the drawings. As such, because the sidewall of the openable ring 40, which has sealed the nib opening 51, is rotated, the nib opening 51 meets the circular hole 42 and is thus gradually opened. Thereafter, as shown in FIGS. 15*c*, 16*c* and 17*c*, the nib opening 51 becomes completely aligned with the circular hole 42.

At this time, as shown in FIGS. 16*c* and 17*c*, the circular hole 42 and the internal passage of the O-ring member 50 are arranged along a linear line. In addition, a first end of the elliptical hole 41 is brought into contact with the nib extension tube, and the protrusions 43 are brought into contact with the second ends of respective guide slots 17.

In this state, as shown in FIGS. 16*d* and 17*d*, when the knock part is pushed further and the cartridge 20 is thus advanced further, the upper support stops 52 of the O-ring member 50 are brought into contact with the inner surface of the casing 10, so that the R-ring member 50 cannot be advanced any further forwards. Furthermore, because the protrusions 43 are in the state in which they are in contact with the respective guide slots 17, the openable ring can also be rotated no further in the direction in which it has been rotated, that is, in the clockwise direction. As such, the openable ring 40 and the O-ring member 50, which are coupled to each other, cannot be advanced any further forwards, and maintain the state of FIGS. 16*c* and 17*c*.

Therefore, in this state, even if the knock part is pushed further, only the cartridge 20 is further advanced forwards, so that the nib passes through the nib opening 51. As a result, as shown in FIGS. 15*e*, 16*e* and 17*e*, the nib is exposed outside the casing 10 through the nib hole. In this state, in which the nib is exposed outside, the spring has maximum restoring force, but, because the cartridge is fastened to the casing by the extraction and retraction control unit 11, the writing instrument maintains the state of allowing the user to use it to write.

Meanwhile, to retract the nib into the casing 10, when the knock part is pushed again, the extraction and retraction control unit releases the cartridge 20 from the casing 10 such that the cartridge 20 can be retracted backwards.

Then, as shown in FIG. 15*f*, the nib is first moved backwards and passes through the internal passage of the O-ring member 50 without movement of the O-ring member 50 or the openable ring 40.

Thereafter, as shown in FIG. 15*g*, when the nib is moved backwards to a predetermined distance, a stepped part of the nib extension tube is held by the nib sealing member 53, thereby the O-ring member 50 and the openable ring 40, which is coupled to the O-ring member 50, are moved backwards together, as shown in FIG. 15*h*.

As such, when the openable ring 40 is moved backwards and is rotated in a counterclockwise direction, the protrusions 43, which have contacted the second ends of the guide slots 17 of the casing 10, are moved to and brought into contact with the first ends of the guide slots 17.

Here, the counterclockwise rotation of the openable ring 40 means the counterclockwise rotation of the sidewall thereof, including the elliptical hole 41 and the circular hole 42. Therefore, the nib opening 51, which has been exposed through the circular hole 42, is gradually closed by the sidewall of the openable ring 40.

Thereafter, the sidewall of the openable ring 40 completely closes the nib opening 51, and the protrusions 43 are brought back into contact with the respective first ends of the guide slots 17. Ultimately, the writing instrument enters the state of FIGS. 15*a*, 16*a* and 17*a*, in which the nib is airtightly stored in the O-ring member 50.

The invention claimed is:

1. A retractable writing instrument having a dryness prevention device, and including an extraction and retraction control unit, the retractable writing instrument comprising:

a casing (10), having coupling means at a position spaced apart from a nib hole (13) by a predetermined distance;

a cartridge (20), having a nib coupling protrusion (22) to couple a nib (24) and a nib extension tube (23) to each other;

a spring for providing elastic restoring force to the cartridge (20) in a direction in which the cartridge (20) is pushed;

an O-ring member (50), which is closely coupled to the nib extension tube (23); and an openable ring (40) coupled to the O-ring member (50) such that the O-ring member (50) is received in the openable ring (40), the openable ring (40) being coupled to the casing (10) through the coupling means so as to be rotatable with respect to the O-ring member (50) to open or close a nib opening (51), so that, when a knock part (29) is pushed, the openable ring (40) is rotated with respect to the O-ring member (50), which is operated in conjunction with the knock part (29) and the cartridge, such that a through passage is opened in an axial direction of the nib (24), and the nib (24) is protruded outside through the nib hole (13), thus entering a state of permitting use thereof, and, when the cartridge (20) is moved backwards, the nib coupling protrusion (22) of the cartridge (20) holds the O-ring member (50) and is moved backwards along with the O-ring member (50), thereby the openable ring (40) is rotated, thus closing the through passage of the O-ring member (50).

2. The retractable writing instrument having the dryness prevention device according to claim 1, wherein the casing (10) comprises a linear rib (18) provided on an inner surface of the casing in an axial direction, such that an end of the spring is caught by the linear rib and is thus prevented from rotating.

3. The retractable writing instrument having the dryness prevention device according to claim 1, wherein, the openable ring (40), which rotates to open or close the O-ring member (50), has:

an elliptical hole (41) formed through a sidewall of the openable ring to provide a guide line such that the openable ring is rotatable in a state in which the O-ring member and the nib are retracted in the casing;

a circular hole (42) to open the nib opening (51) such that the nib, which is airtightly placed in the O-ring member (50), is movable towards the nib hole (13); and a pair of protrusions (43) extending from opposite edges of the sidewall of the openable ring (40), the protrusions (43) being movably placed in the coupling means of the casing (10) such that the openable ring (40) is rotated while conducting linear movement.

4. The retractable writing instrument having the dryness prevention device according to claim 1, wherein the O-ring member comprises:

a pair of upper support stops (52) linearly extending from a sidewall (55) of the O-ring member in an outward direction from the nib opening (51); and a pair of lower support stops (54) linearly extending from the sidewall (55) of the O-ring member (50) in an outward direction from a nib sealing member (53), so that the upper support stops and the lower support stops support the openable ring (40) such that the openable ring (40), which is coupled to the O-ring member (50), is prevented from being removed from the O-ring member (50) when the openable ring (40) is rotated with respect to the O-ring member (50).

5. The retractable writing instrument having the dryness prevention device according to claim 1, wherein the coupling means provided in the casing (10) comprises a pair of guide slots (17), which are symmetrically formed through the casing (10) at positions spaced apart from the nib hole (13) by a predetermined distance, and the protrusions (43) are movably placed in the respective guide slots (17).

* * * * *